United States Patent [19]

Stelter

[11] Patent Number: 4,980,727

[45] Date of Patent: Dec. 25, 1990

[54] TONER CONCENTRATION CONTROL SYSTEM

[75] Inventor: Eric C. Stelter, Rochester, N.Y.

[73] Assignee: Eastman Kodak Company, Rochester, N.Y.

[21] Appl. No.: 503,022

[22] Filed: Apr. 2, 1990

[51] Int. Cl.[5] ..... G03G 21/00

[52] U.S. Cl. ..... 355/246; 355/208

[58] Field of Search ..... 355/246, 245, 208, 204, 355/203; 118/653, 644; 324/76 R, 96; 250/338.1

[56] References Cited

U.S. PATENT DOCUMENTS

| | | | |
|---|---|---|---|
| 3,897,748 | 8/1975 | Hirata et al. | 118/7 |
| 4,155,638 | 5/1979 | Blitzer | 355/246 |
| 4,326,646 | 4/1982 | Lavery et al. | 222/56 |
| 4,572,102 | 2/1986 | Yuge et al. | 118/689 |
| 4,648,702 | 3/1987 | Goto | 355/208 |
| 4,801,980 | 1/1989 | Arai et al. | 355/246 X |
| 4,829,336 | 3/1989 | Champion et al. | 355/246 |
| 4,833,506 | 5/1989 | Kuru et al. | 355/208 |
| 4,883,019 | 11/1989 | Menjo et al. | 355/246 X |

*Primary Examiner*—A. T. Grimley
*Assistant Examiner*—Sandra L. Hoffman
*Attorney, Agent, or Firm*—Milton S. Sales

[57] ABSTRACT

Apparatus and method for controlling the toner concentration of developer mixtures in electrostatographic devices. Light is reflected from the developer and the light reflectance ratio is converted to electrical signals by a two-path circuit. Both the gain and offset of a circuit amplifier are controllable to allow for optimum response to carriers of different reflectivities. The gain is set depending upon the desired sensitivity and the offset voltage is set to establish the output voltage at a predetermined point for the particular carrier and toner being used.

17 Claims, 3 Drawing Sheets

FIG. 3
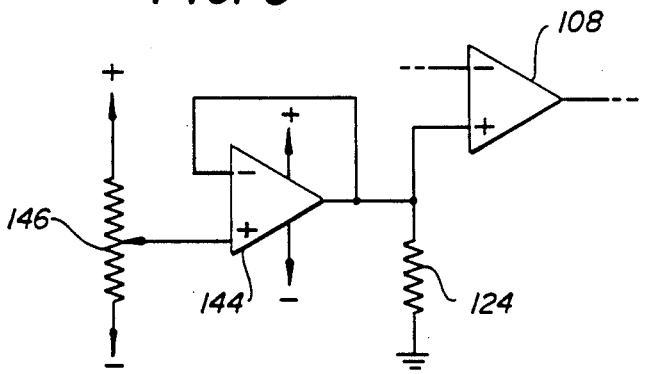
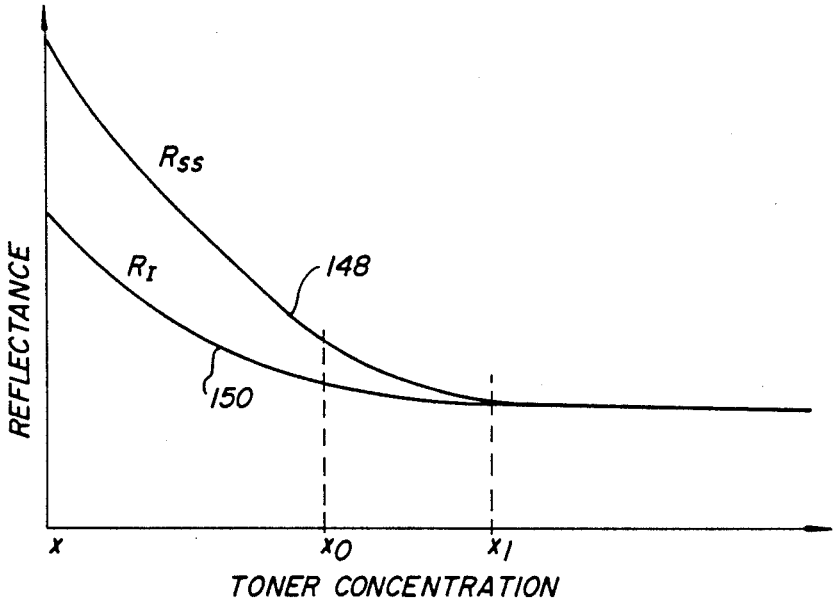
FIG. 4

TONER CONCENTRATION CONTROL SYSTEM

BACKGROUND OF THE INVENTION

1. Field of the Invention

This invention relates, in general, to photocopying and, more specifically, to toner concentration monitors used in copiers, printers, and like devices.

2. Description of the Prior Art

Various forms of electrostatographic apparatus, such as electrophotographic copiers and printers and electrographic stylus and pin recording devices, use dry powdered toner to develop the latent images created by the particular exposure or writing process. Frequently, the developer is a mixture of carrier particles and toner particles. In order for the apparatus to produce quality hard copy outputs, it is necessary to maintain the concentration of the mixture within relatively narrow limits. Thus, the ratio of toner to carrier particles in the mixture must be accurately maintained.

Before toner concentration can be maintained within tight tolerances, there must be a reliable and efficient method of measuring the toner concentration. Various types of systems have been used for this purpose according to conventional practices. One type of system measures the density of a test patch developed on the latent image-bearing member of the apparatus. Another type of prior art system measures the magnetic properties of the developer and equates that to a ratio of nonmagnetic toner particles and magnetic carrier particles. Still another type of system optically measures the amount of light reflected from the development mixture to determine the carrier-toner ratio. This type of system relies upon the fact that the carrier particles and the toner particles have different light reflectance values or coefficients. Thus, when the concentration ratio changes from the desired value, the reflectance of the mixture either increases or decreases. Usually, the toner is darker than the carrier and decreasing the ratio of toner to carrier causes an increase in the light reflectance from the developer.

U.S. Pat. No. 4,833,506, issued on May 23, 1989, discloses a system for controlling the toner density in a copying machine. In this patent, a test patch is developed on the photosensitive drum and the density of the patch is measured by an optical sensor. U.S. Pat. No. 4,326,646, issued on Apr. 27, 1982, also discloses a toner concentration control system which uses a developed test patch. In this patent, the gain of the detection circuit (FIG. 4*a*) is changed by a system controller which is connected to the feedback branches of the circuit amplifier. The detected signal is applied to one input of an operational amplifier and the other input is used for controlling the effective gain of the amplifier. In both these patents, the monitoring systems are not measuring the carrier-toner concentration directly, as substantially no carrier is on the test patch.

U.S. Pat. No. 4,572,102, issued on Feb. 25, 1986, is indicative of systems which measure the developer directly in the developer container. With such systems, the developer mixture being measured usually contains both carrier and toner particles as contrasted to test patch systems which predominantly measure only toner particles. In this particular patent, the developer contains two different types of toner which are separately measured for light reflectance. The measured values are compared to each other (FIG. 4) and ultimately control the replenishment of toner in the developer. A level sensor 50 is used to measure the amount of developer in the container.

U.S. Pat. No. 4,155,638, issued on May 22, 1979 to the same assignee as the present invention, discloses a toner concentration monitor which measures the light reflectance of the developer contained in the developer container, as does the present invention. Both direct and reflected light sensors are used to measure the reflectance of the mixture in the container. The two signal processing circuits 69 and 72 in the referenced patent are connected to a digital computer which determines if replenishment is necessary.

Some development mixtures contain carrier particles which are more reflective than others. Highly reflective stainless steel carriers are used in developers which include both metallic particles and toner particles which are intended to be deposited on the developed image. This type of developer is used when the produced image is to contain magnetic particles which can aid in scanning text and numbers contained in the image produced on the hard copy. The difficulty with such developers when used with the conventional toner concentration monitors is the fact that the increased reflectance of the carrier causes the detector circuits to operate outside normally designed ranges. This is attributed to the fact that the reflectance of the developer is much higher than normal even when the toner concentration is optimum. The increased reflectance can be compensated for by changing the amplifying ratio or gain of the circuits, or by increasing the range of the A/D converter through which the measured reflectance is applied to the computer circuitry. However, this also changes the response and accuracy of the system. If, for instance, the gain needs to be lowered significantly to compensate for the highly reflective carrier, the system will have difficulty responding fast enough to correct large errors in toner concentration. If the gain needs to be raised to compensate for the reflectance of the carrier, the system may become unstable and respond by overreacting to small changes in toner concentration.

To increase the versatility of a toner concentration control system, it is also necessary to be able to adjust the system for different toner concentration aim or desired levels without changing the stability and/or response of the system. Therefore, it is desirable, and an object of this invention, to provide a universal toner concentration control system which can be used effectively with a wide range of toner and carrier materials, including highly reflective carrier particles, and which enables adjustment of the aim toner concentration without changing the sensitivity of the toner concentration monitor.

SUMMARY OF THE INVENTION

There is disclosed herein a new and useful toner concentration control system which monitors and controls the relative amount of toner and carrier in the developer of an electrostatographic device, such as an electrophotographic copier or printer. The system includes a light source and two optical-to-electrical converters or sensors. One sensor detects the light from the source directly and is used as a reference. The other sensor detects light from the source after it is reflected from the developer mixture being monitored. The reflected signal from the sensor is processed by a reflected circuit and the reference signal from the other sensor is processed by a reference circuit of active and passive components In the reflected circuit, both the gain and the setpoint of the output are controlled to provide optimum performance. The gain is controlled by adjusting the amplification ratio of an operational amplifier in the circuit during a set-up or calibration procedure. An offset voltage is applied to one input of the operational amplifier to set the magnitude of the output within the desired range at the aim toner concentration. The offset voltage can be manually controlled or can be under the control of software in a processor. Changing the offset determines the aim or desired concentration level and allows the control system to operate effectively with carriers having widely diverse reflectivities.

The outputs of the reference and reflected circuits are changed to digital values and applied to a digital processor. The software in the processor determines whether toner needs to be added to the developer to maintain proper concentration. The overall result of using both offset and gain controls is the ability of the system to properly control developers containing, at separate times, normal carriers and carriers of highly reflective materials without requiring an analog-to-digital converter which is very accurate over a wide range of input voltages. In addition, this system has the ability to change the aim toner concentration of a developer to improve image quality without changing the responsiveness of the toner concentration monitor.

BRIEF DESCRIPTION OF THE DRAWINGS

Further advantages and uses of this invention will become more apparent when considered in view of the following detailed description and drawings, in which:

FIG. 3 is a partial circuit diagram of the invention using manual adjustment for the offset voltage; and FIG. 4 is a graph illustrating the reflectance as a function of toner concentration for carriers of different reflectance.

DESCRIPTION OF THE PREFERRED EMBODIMENTS

Figure 1:
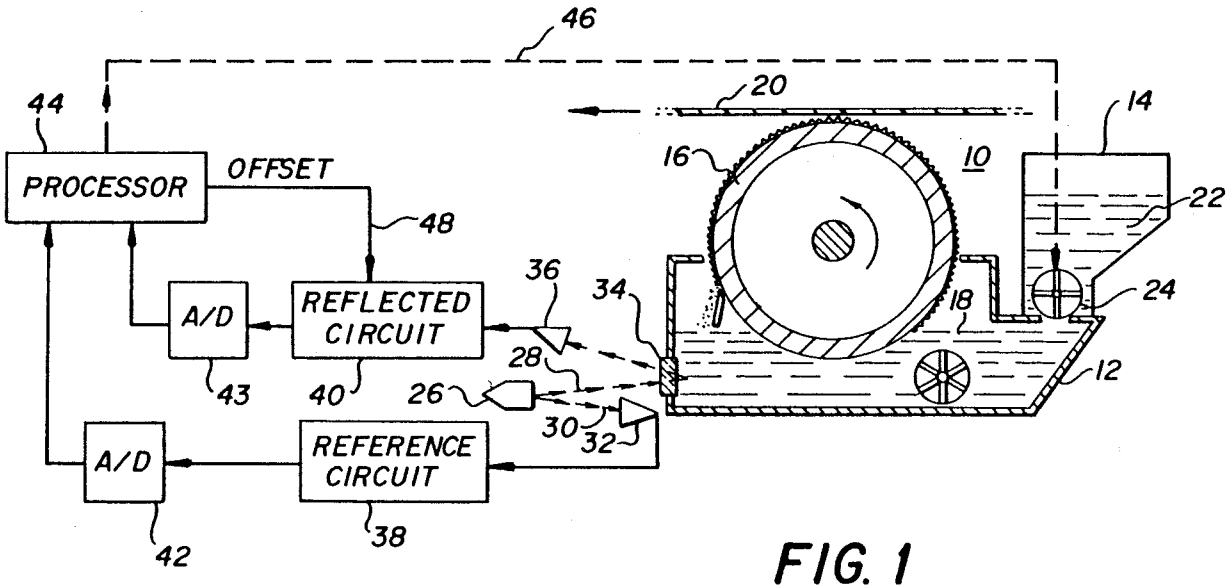
FIG. 1 is a diagram illustrating the relationship between the circuit portion of the invention and a developing station.

Throughout the following description, similar reference characters refer to similar elements or members in all of the figures of the drawings.

Referring now to the drawings, and to FIG. 1 in particular, there is shown a diagram of an electrostatographic device using the invention. The developing station 10 of the device includes the developer container 12, the toner replenishment container 14, and the toner brush 16. The developer 18 enclosed within the container 12 is transferred by the toner brush 16 to the latent image on the photoconductor or photosensitive member 20. The developer 18 in this specific embodiment of the invention is a mixture of carrier and toner particles. This mixture is maintained at a desired concentration level, or ratio of carrier and toner, by replenishing the mixture with toner 22 upon operating or controlling the gate or valve 24. Various other types of developing stations can be used with the concentration monitoring and control system of this invention.

In this specific embodiment of the invention, a light emitter 26, such as an infrared LED, emits light as indicated by rays or beams 28 and 30. Light beam 30 is detected by the light sensor 32, which can be a photodiode. Light beam 28 passes through the transparent window 34 of the developer container 12 and is reflected from the developer 18 in the container back to light sensor 36, which can also be a photodiode. Thus, sensor 32 senses or detects light which is indicative of the amount or intensity of the light emitted by the light emitter 26, and sensor 36 senses or detects the amount of light reflected from the developer 18. The reflectivity of the developer 18 affects the amount of light detected by the sensor 36. Since the toner particles have a different reflectivity than the carrier particles, the overall reflectance of the mixture 18 is indicative of the toner concentration of the developer. In most cases, the toner particles will be darker than the carrier particles. Thus, when the reflectance of the mixture 18 increases, it is indicative that the toner concentration has decreased, and the control circuit would be operative to cause additional toner to be added to the mixture 18.

The signal from the sensor 32 is applied to a reference circuit 38 and the signal from the sensor 36 is applied to the reflected circuit 40. The reference and reflected circuits, or circuit paths, can contain appropriate amplifiers, filters, and biasing networks for conditioning the reference and reflected signals for application to the analog-to-digital converters 42 and 43. The resultant digital signals are applied to the processor 44, which can be a digital computer or microprocessor system. The processor 44 looks at the reference and reflected values applied thereto and determines whether toner replenishment is necessary and, if determined to be necessary, channel 46 is activated to energize the gate or valve 24.

Various algorithms may be used by the processor 44 to determine when to add toner based upon the reflected and reference circuit inputs. A simple algorithm may be used wherein toner is only added when the voltage from the reflected circuit is greater than the voltage from the reference circuit. This assumes, of course, that the two circuits have been adjusted previously so that when the toner concentration of the developer is optimum, the voltages produced by the two reference circuits are equal. Since sensor 32 would always detect more light than sensor 36, reference circuit 32 would be adjusted to provide less gain to the sense signal than the reflected circuit 40. More sophisticated algorithms may be used by the processor 44 to determine when toner is to be added. For example, the algorithm may take into consideration both current and previous values of the voltages or signals derived from the reference and reflected circuits. The offset control line 48 is used by the processor 44 to set the aim or desired level of the toner concentration for the developer 18. The offset control line 48 can also compensate for the difference in reflectivities of carriers in the developer 18. Since some carriers are more reflective than others, the offset control line 48 allows the toner concentration control system of this invention to be used with toner and carrier mixtures which have a wide range of reflectivities. As will be described later, the offset control line 48 changes the output of the reflected circuit 40 without changing its gain or amplification ratio and can be used to change the aim toner concentration without changing the toner concentration monitor sensitivity.

Figure 2:
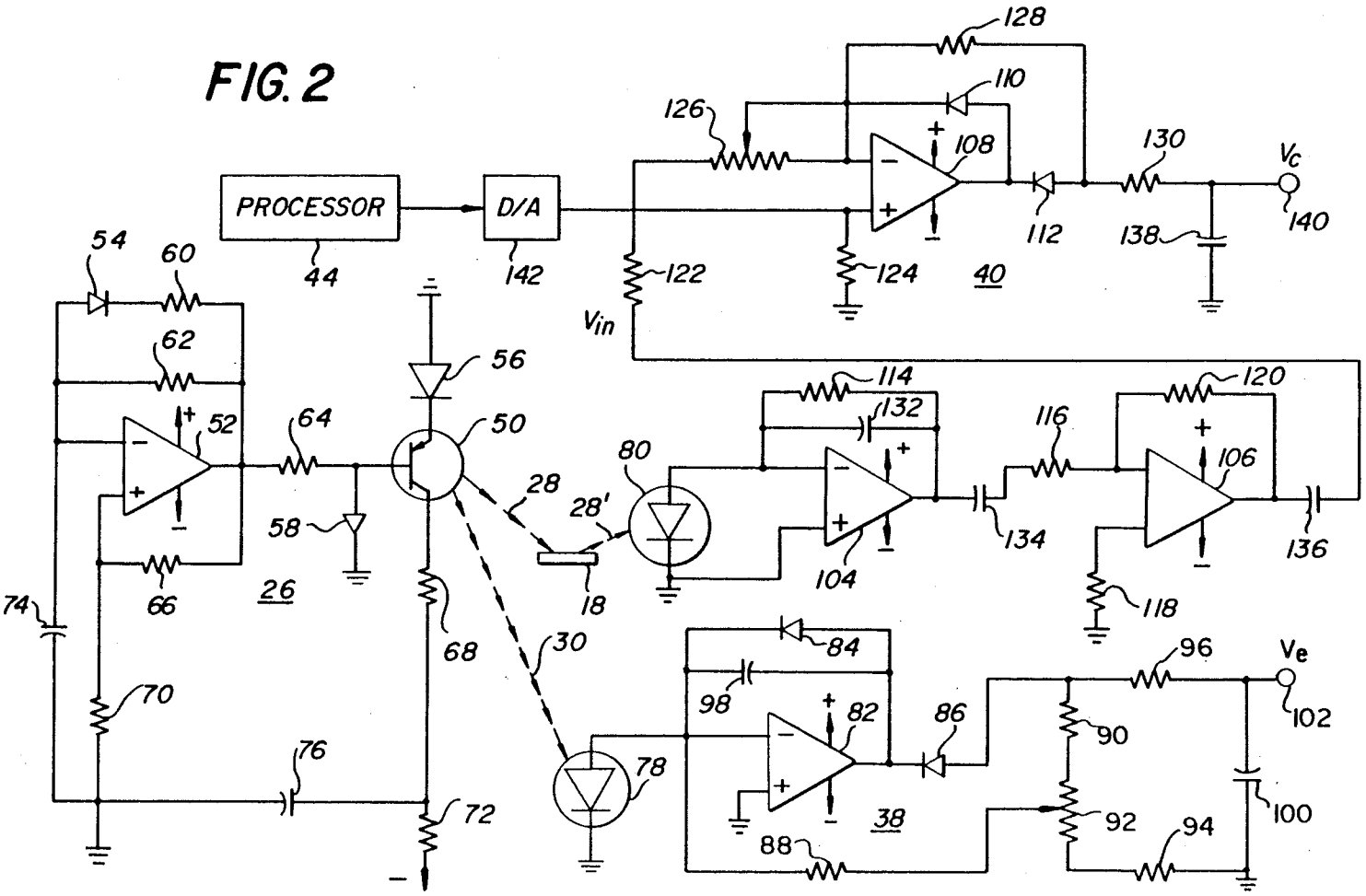
FIG. 2 is a schematic circuit diagram of a circuit utilizing the invention according to one specific embodiment.

FIG. 2 is a schematic diagram showing primarily the light emitter, the light sensors, and the reference and reflected circuits described generally in FIG. 1. In FIG. 2, the light emitter 26 consists mainly of the LED 50 and the operational amplifier 52. These components are supported by the diodes 54, 56 and 58, the resistors 60, 62, 64, 66, 68, 70 and 72, and the capacitors 74 and 76. The resulting circuit produces light beams which are strobed or square-wave amplitude modulated so that they are turned on and off at a predetermined cycle rate. Strobing of the light beams increases the signal-to-noise ratio of the system. The direct light beam 30 from the LED 50 is detected by the photodiode 78, and a reflected light beam 28' from the developer 18 is detected by the photodiode 80.

The reference circuit 38 consists mainly of the photodiode 78 and the operational amplifier 82. The support components include the diodes 84 and 86, the resistors 88, 90, 92, 94 and 96, and the capacitors 98 and 100. The resulting DC voltage $V_e$ produced at terminal 102 represents the voltage which is proportional to the emitted light from the light emitter 26. Variable resistor 92 provides means for adjusting the sensitivity or gain of the amplifier 82 and thus controls the setting of $V_e$ for a particular developer mixture.

The reflected circuit 40 consists mainly of the photodiode 80 and the operational amplifiers 104, 106 and 108. The support components for this circuit include the diodes 110 and 112, the resistors 114, 116, 118, 120, 122, 124, 126, 128 and 130, and the capacitors 132, 134, 136 and 138. The cascaded amplifier system is used to achieve the desired gain for the overall circuit and to filter out unwanted signal frequencies. A low pass filter is provided by the capacitors and resistors near the output of the reference circuit 38. Similar filtering is produced at the output of the reflected circuit 40. The resulting DC output voltage $V_c$ is applied to terminal 140 of the reflected circuit 40. $V_c$ is indicative of the amount of light sensed after it is reflected from the developer and is also indicative of the toner concentration.

Adjusting the amplification of the operational amplifier 108 is provided by the variable resistor 126. Setting the offset or operating point of the operational amplifier 108 is provided by the signal from the processor 44 which is applied to the operational amplifier 108 through the digital-to-analog converter 142. This offsetting voltage $V_x$ is applied to the non-inverting terminal of the operational amplifier 108. Due to the diodes 110 and 112, only the positive portion of the input signal $V_{in}$ is amplified. For positive $V_{in}$, the output $V_{out}$ of the amplifier before filtering is given by:

$$V_{out} = -V_{in}[R_{128}/(R_{122}+R_{126})]+V_x. \quad (1)$$

For negative $V_{in}$, the output is:

$$V_{out} = V_x. \quad (2)$$

Increasing $V_x$ decreases the magnitude of $V_c$, essentially making the developer look darker and causing the toner concentration to decrease. By having the ability to adjust both the gain and the offset of the amplifier in the reflected circuit 40, various types of toners and carriers can be used in the developer mixture while still allowing the circuitry of this invention to adequately and precisely control the toner concentration. This also allows the aim toner concentration to be adjusted during operation with a particular developer without changing the responsiveness of the toner concentration monitor to fluctuations in toner concentration.

As shown in FIG. 1, the voltages $V_e$ and $V_c$ are applied through analog-to-digital converters to the processor 44 which determines, according to the appropriate algorithm, whether the voltages indicate that toner needs to be added to the developer mixture. In actual practice, the adjustment of the circuit requires the adjustment of resistor 92, the resistor 126, and the offset voltage $V_x$. One method for making these adjustments is to use a standard or calibrated module which replaces temporarily the developer 18 so that a known reflectance value is produced. Using the standard device, the emitted voltage $V_e$ is adjusted by resistor 92 to a voltage which is in the middle of the operating range of the operational amplifier 82. Next, the resistor 126 is adjusted to set the concentration voltage $V_c$ to a value indicated on the calibrated device and previously determined to represent the desired gain for the reflected circuit of the monitor. This same procedure is presently being used on existing apparatus with similar monitor circuits. Finally, the offset voltage $V_x$ is adjusted so that $V_c$ is equal to $V_e$ when the actual developer 18 is used to reflect the light.

By using the combination of gain and offset adjustments, the alignment procedure allows the gain or amplification of the circuits to be optimized for proper response to changes in the toner concentration. With separate controls for the sensitivity of the system, instability and low response of the system to toner fluctuations can be eliminated. By using the offset voltage $V_x$ to set the aim or desired toner concentration level and for setting the amplifier output voltage $V_c$ for the particular toner and carrier mixture being used, the circuitry shown in FIG. 2 can be used with a wide variety of toner and carrier combinations even when the reflectivity of the components varies over a wide range. Adjusting $V_x$ also provides a means of adjusting the toner concentration of a specific developer during operation.

FIG. 3 shows a modification to the circuit shown in FIG. 2 which can be used to manually adjust the offset voltage $V_x$. In FIG. 3, the operational amplifier 144 and the variable resistor 146 replace the processor derived voltage applied to the noninverting terminal of the operational amplifier 108. This allows for manual adjustment of the offset voltage $V_x$ and may be used when it is not necessary to change the aim concentration under software control. The operational amplifier 144 in this circuit is operating as a voltage follower and is required to avoid reducing the resistance at the input of operational amplifier 108 due to a parallel connection between the variable resistor 146 and the fixed resistor 124.

FIG. 4 is a graph illustrating the reflectance as a function of toner concentration for developers containing carriers having two different reflectivities. Line 148 represents a developer with a carrier consisting of a highly-reflective stainless steel material $R_{SS}$. Line 150 represents a developer with a carrier material consisting of a less reflective material, such as sponge iron $R_I$. As can be seen from FIG. 4, when the toner concentration is above a value $x_1$, the two types of developers exhibit the same reflectances. This is because the carriers are substantially covered by the toners and their reflectances do not play an important part in the overall reflectance from the toner mixture. As the toner concentration (percent by weight) decreases, the reflectance from the developer approaches that of the individual carriers. Although somewhat different reflectivities may be used, actual measurements of typical materials have indicated that highly reflective stainless steel carrier reflects 15.7% of incident light and conventional sponge iron carrier reflects 5.5% of incident light.

The need for two independent adjustments, offset and gain, for the reflectance in a toner concentration monitor designed to control developer reflectivity and work with a wide variety of carriers having different reflectivities can be shown by expanding the reflectivity of the developer in a Taylor series about the aim or desired toner concentration. As shown in FIG. 4, the reflectance of a developer decreases as the toner concentration increases. In this analysis, it is assumed that both developers are made with the same black toner, and that the carriers are more reflective than the toners.

The reflectance for any developer D about a concentration $x_0$ can be written as a Taylor series:

$$R_D(x)=R_D(x_0)+R'_D(x_0)(x-x_0)+R''_D(x_0)(x-x_0)^2/2!+ \quad (3)$$

Now, consider the Taylor series for a developer made with stainless steel carrier, $R_{SS}(x)$, in comparison to the Taylor series for one made with sponge iron carrier, $R_I(x)$. Since the stainless steel carrier is more reflective than the sponge carrier, as shown in FIG. 4, it can be represented that:

$$R_{SS}(x_0)>R_I(x_0). \quad (4)$$

In addition, since adding one toner particle to a carrier particle will decrease the reflectivity of the stainless steel carrier more than that of the sponge iron carrier, the following is true:

$$|R'_{SS}(x_0)|>|R'_I(x_0)|. \quad (5)$$

For very high toner concentrations, or $(x-x_0)$ large, the carriers will be completely coated with toner and the reflectance of the two developers will converge at $x_1$ to the reflectance of the toner. Therefore, all second order and higher terms in the Taylor series of equation (3) are essentially identical. Since the reflectivity of a developer at high toner concentrations is approximately constant, the higher order terms are also very small. This leaves two independent parameters for any developer, a constant $R_D(x_0)$, and a slope $R'_D(x_0)$. The circuit of FIG. 2 uses the offset voltage adjustment and a gain adjustment to map $R_D(x_0)$ and $R'_D(x_0)$ for any given developer into machine-controllable ranges.

Another factor which affects the operation of the circuitry shown in FIG. 2 is the noticeable downward drift in $V_e$ due probably to a decrease in LED intensity of the emitter as the circuit achieves operating temperature and also because of a degration of the LED with age. Although it turns out that this does not cause the aim toner concentration to change, it does change the monitor response, or sensitivity to toner concentration fluctuations, and can be compensated for by the processor software. To see if the monitor is stable for LED intensity variations, it can be modeled by assuming that:

$$V_e=G_{Ve}I \quad (6)$$

and $$V_c=G_{Vc}R_D(x)I, \quad (7)$$

where $G_{Ve}$ and $G_{Vc}$ are the gains for the reference and reflected signals, I is the LED intensity, and $R_D(x)$ is the developer reflectance. Assume that the monitor has been set up so that $V_c$ is equal to $V_e$ at the aim toner concentration, $x_0$. The effect of variations in I can be found by examining:

$$V_c-V_e=G_{Vc}R_D(x_0)I-G_{Ve}I=0, \quad (8)$$

or, $$G_{Vc}R_D(x_0)-G_{Ve}=0. \quad (9)$$

Since equation (9) is independent of I, $V_c-V_e$ will continue to be equal to 0, if the reflectance of the developer remains constant, even if I increases or decreases after the monitor has been initially calibrated. The aim toner concentration, therefore, is independent of variations in LED intensity.

The toner concentration monitor response in voltage per percent change of toner concentration can be found by substituting equation (3) for the developer reflectance into equation (7) for $V_c$ and taking the derivative with respect to concentration, x, neglecting higher order terms in x. This can be represented as:

$$dV_c/dx=G_{Vc}R'_D(x_0)I. \quad (10)$$

A decrease in I will decrease the monitor responsiveness which can lead to fluctuations in toner concentration control if the monitor becomes too insensitive to react to large fluctuations in toner concentration. To eliminate this error, $V_c-V_e$ can be divided by $V_e$ by a software routine in the processor.

There has been disclosed a toner concentration control system which is useful for precisely monitoring and controlling concentrations of toner and carrier particles having wide variations in reflectivities. The circuitry allows for a gain adjustment to determine the appropriate response to toner fluctuations and an offset adjustment to maintain the operating range within desired levels even with carriers of different reflectivities. The off-set control can also be used to adjust the aim toner concentration by increasing or decreasing the output of the reflected circuit relative to the reference circuit.

It is emphasized that numerous changes may be made in the above-described system without departing from the teachings of the invention. It is intended that all of the matter contained in the foregoing description, or shown in the accompanying drawings, shall be interpreted as illustrative rather than limiting.

I claim as my invention:

1. A toner concentration control system suitable for use with electrostatographic apparatus which uses a developer containing at least carrier particles and toner particles, said control system comprising:

means for producing light;

first means for sensing the intensity of said produced light and applying the sensed quantity to a reference circuit path;

second means for sensing the intensity of said produced light after it is reflected from the developer and applying the sensed quantity to a reflected circuit path;

amplifying means for changing the gain of the reflected circuit path;

offset means for adjusting the output of the amplifying means without changing its gain; and means responsive to the outputs of the reference and reflective circuit paths for causing toner to be added to the developer.

2. The control system of claim 1 wherein the carrier particles consist of a magnetized metallic material which has a high reflectivity to light.

3. The control system of claim 1 wherein the first sensing means is responsive to the produced light before it is reflected from the developer, and the second sensing means is responsive to the produced light after it is reflected from the developer which is contained in a developer enclosure which supplies developer to other members of the apparatus.

4. The control system of claim 1 wherein the amplifying means includes at least one two-input operational amplifier, with the signal derived from the second sensing means being applied to the first of the two inputs, and with the second of the two inputs being used with the offset adjusting means.

5. The control system of claim 4 wherein the offset adjusting means includes means for providing a fixed voltage which is applied to the second of the two inputs.

6. The control system of claim 5 wherein the voltage applied to the second of the two inputs is derived from a digital processor system using a digital-to-analog converter.

7. The control system of claim 1 wherein the means responsive to the outputs of the circuit paths uses other inputs and information about previous actions to determine when toner is to be added to the developer.

8. The control system of claim 1 wherein the light produced by the light producing means is confined substantially to the infrared wavelengths.

9. The control system of claim 1 wherein the light produced by the light producing means is square-wave modulated.

10. The control system of claim 1 wherein the outputs of the circuit paths are DC values.

11. The control system of claim 10 wherein the value of the DC output voltage of the reflective circuit path is changed by adjusting the offset means.

12. The control system of claim 10 wherein the offset means is set to lower the DC output voltage of the reflective circuit when the reflectivity of the carrier particles is higher.

13. A toner concentration control system suitable for use with electrostatographic apparatus which uses a developer containing at least highly reflective, metallic, carrier particles and toner particles, said control system comprising:

emitter means for producing amplitude modulated, infrared light;

first means for sensing the intensity of said produced light before it is reflected from the developer and applying the sensed quantity to a reference circuit path;

second means for sensing the intensity of said produced light after it is reflected from the developer and applying the sensed quantity to a reflected circuit path;

at least one two-input operational amplifier for changing the gain of the reflected circuit path, with the signal derived from the second sensing means being applied to a first of said two inputs;

means for providing a fixed voltage which is applied to the second of said two inputs, said fixed voltage affecting the output voltage of the operational amplifier without changing its gain and providing a means for adjusting the toner concentration; and means responsive to the DC voltage outputs of the reference and reflective circuit paths for causing toner to be added to the developer based at least in part upon a comparison of the two voltage outputs.

14. The control system of claim 13 wherein the fixed voltage is set to lower the DC output voltage of the reflective circuit when the reflectivity of the carrier particles is higher.

15. The control system of claim 13 wherein the highly reflective carrier particles reflect more than 10% of incident light.

16. A method of controlling the toner concentration in electrostatographic apparatus which uses a developer containing at least carrier particles and toner particles, said method including the steps of:

acquiring a direct light quantity;

acquiring a reflected light quantity by measuring an amount of light reflected from the developer;

amplifying and converting the quantities into DC voltages;

changing the DC voltage value of the reflected light quantity without changing the amplifying ratio;

comparing the voltages corresponding to the direct and reflected light quantities; and replenishing toner based at least partly upon the voltage comparison.

17. The method of controlling toner concentration of claim 16 wherein the DC value of the reflected light quantity is lowered when the reflectivity of the carrier particles is increased.

* * * * *